United States Patent [19]

Rouse

[11] Patent Number: 4,519,550

[45] Date of Patent: May 28, 1985

[54] MATERIAL GUIDE AND CLEANER FOR COMMINUTING APPARATUS

[75] Inventor: Michael W. Rouse, West Linn, Oreg.

[73] Assignee: Waste Recovery, Inc., Dallas, Tex.

[21] Appl. No.: 625,587

[22] Filed: Jun. 29, 1984

Related U.S. Application Data

[63] Continuation of Ser. No. 356,317, Mar. 9, 1982, abandoned.

[51] Int. Cl.[3] ..... B02L 7/04

[52] U.S. Cl. ..... 241/167; 241/236; 241/DIG. 31

[58] Field of Search ..... 241/166, 167, 236, DIG. 31; 83/122, 168

[56] References Cited

U.S. PATENT DOCUMENTS

| | | | |
|---|---|---|---|
| Re. 23,506 | 5/1952 | Jackson . | |
| 1,067,269 | 7/1913 | Palmer | 83/122 |
| 1,706,935 | 3/1929 | Milne | 241/167 |
| 2,531,105 | 11/1950 | Brown . | |
| 2,547,234 | 4/1951 | Spang . | |
| 2,607,952 | 8/1952 | McIntosh . | |
| 3,064,907 | 11/1962 | Biehn | 241/236 |
| 3,931,935 | 1/1976 | Holman | 241/24 |
| 4,018,392 | 4/1977 | Wagner | 241/167 |

*Primary Examiner*—Howard N. Goldberg
*Assistant Examiner*—Timothy V. Eley
*Attorney, Agent, or Firm*—Chernoff, Vilhauer, McClung, Birdwell & Stenzel

[57] ABSTRACT

Material feeding and clearing apparatus for use in a material comminuting apparatus includes a plurality of elongate guide-clearer finger members which extend through the spaces between spaced apart cutting discs or similar elements of each of a pair of intermeshed cutter rolls, from an infeed side of the apparatus to an outlet side to the pair of rolls. The finger members are preferably resilient and extend through a space defined between the shaft or central spacer between spaced apart cutter discs or similar rotating elements of one of the pair of rolls and the peripheral surface or edge of a rotating cutting element of the intermeshed rotatable cutting roll. Similar guide-clearer fingers are associated with each rotatable roll and extend upwardly above the infeed side of the pair of rolls, defining an infeed chute on the infeed side.

7 Claims, 6 Drawing Figures

FIG. 1
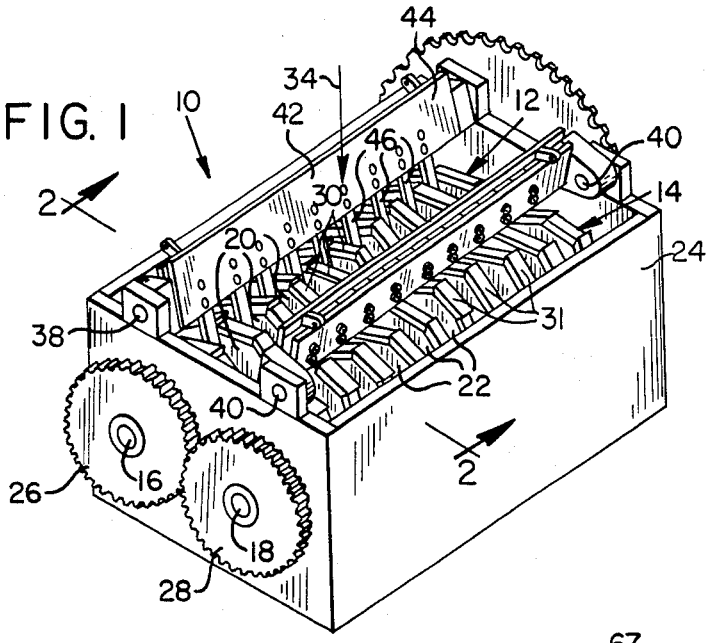
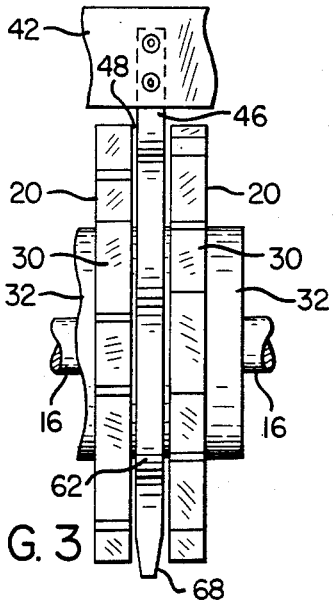
FIG. 3
FIG. 2
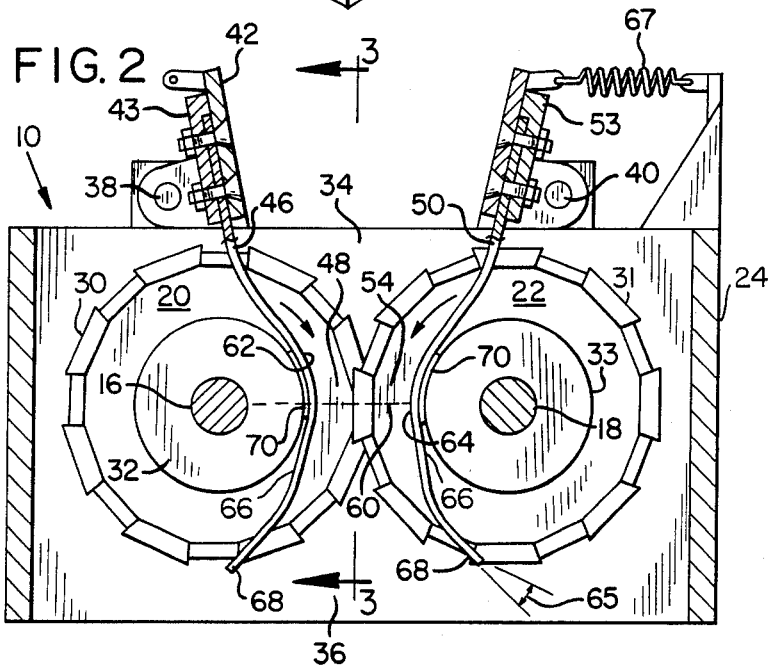
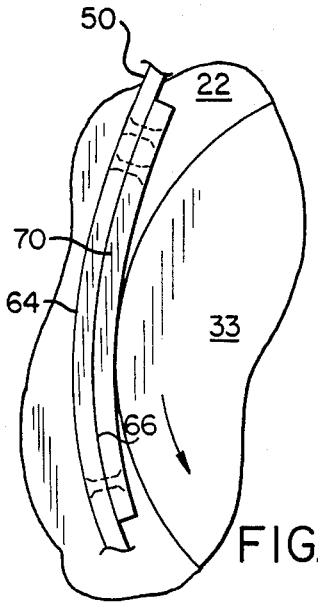
FIG. 4
FIG. 5
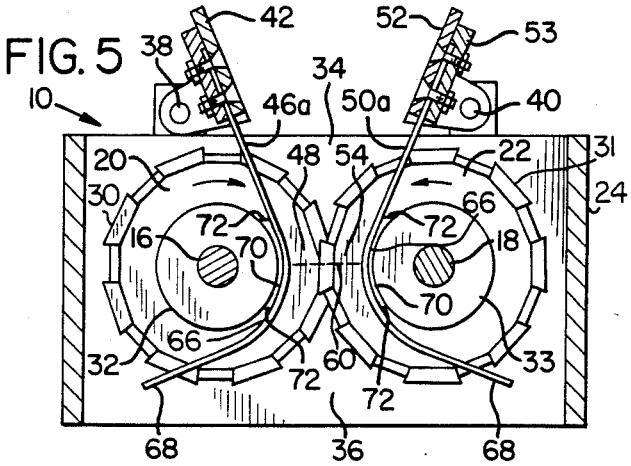
FIG. 6
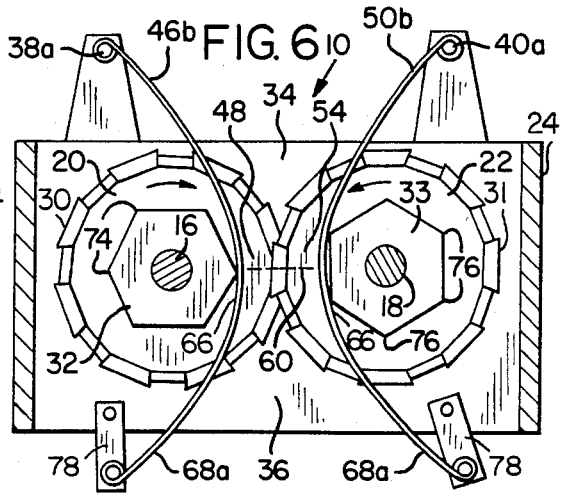

MATERIAL GUIDE AND CLEANER FOR COMMINUTING APPARATUS

This application is a continuation, of application Ser. No. 356,317, filed Mar. 9, 1982 now abandoned.

BACKGROUND OF THE INVENTION

The present invention relates to apparatus for comminuting materials, and particularly to apparatus for guiding waste materials and the like into a shredder and clearing the divided portions of said material from the shredder.

Many devices for comminuting material such as paper waste, plastic waste, rubber tires, and domestic waste include a pair or pairs of generally cylindrical rolls each having axially spaced apart disclike or other rotary cutters which intermesh between spaced apart rotary elements on another one of the rolls. The rotary elements may interact as rotary shears, tearers, or as a hammermill. Depending on its design, such a machine can cut, tear, shred, or pound waste materials and the like into smaller pieces which may then drop or otherpass clear of the intermeshed rolls. A problem often encountered, however, particularly with resilient material such as rubber, is that pieces of the shredded material become caught between the spaced-apart elements of one or both of the rolls, interfering with shredding of additional material.

As has been shown in the past, such materials can be cleared from between the rotary cutting elements and the like of the rolls by stationary sets of elongate members which extend radially inward toward the central axis of the rolls as teeth of a comb to scrape material from between the rotary elements. An example of such a comb-like clearer is shown in Holman U.S. Pat. No. 3,931,935.

Another way to remove the pieces of comminuted material from the shredding apparatus is to use rotating wheels or fingers which pass between the rotary elements of each of the rolls. Such apparatus is shown in Milne U.S. Pat. No. 1,706,935, as well as in Holman.

While such comb-like clearers and rotary clearers are reasonably effective for their purpose, they do have drawbacks. For example, material can quickly accumulate against the faces of the teeth of such comb-like clearers, rubbing against the lateral faces of the discs and thereby increasing the amount of energy needed to rotate the rolls. Pieces of string, yarn, wires, and the like may wrap around the comb teeth and become lodged, causing similar problems. The teeth are also subject to becoming bent.

Rotary clearers may be less likely to become plugged or loaded with shredded material, but energy is required to rotate them, and their complexity adds to the cost of construction and maintenance of a machine including such rotary clearers.

Stationary plates have been provided between the spaced-apart rotary shredding members of paper shredders to clear shredded paper from therebetween, as disclosed in Wagner, U.S. Pat. No. 4,018,392. Such plates, however, have central openings which surround the shafts of the rolls. Pieces of material which may lodge within the central opening in such a plate cannot be easily removed, and contribute to energy waste and wear.

Not only is it necessary to remove cut material from between the spaced-apart discs or other cutters of the rolls of shredding apparatus, but it is also necessary to feed material into the proper location for being shredded by the intermeshed rolls. Although chutes can direct material to generally the proper location, chutes do not guide material the last part of the way into the area where the rolls are actually intermeshed. Large pieces of material and pieces of resilient or slippery material are therefore often likely to bounce about on the infeed side of the intermeshed rolls, rather than being drawn between them.

What is needed, then, is apparatus for use in connection with waste material shredders and the like which have intermeshed rotating rolls, to guide the material to be comminuted into the proper area of the intermeshed rolls, and thereafter to remove the pieces of material from between the spaced-apart rotary cutters or hammers of the rolls to prevent pieces of material from building up and clogging the apparatus. Preferably such apparatus should be sturdy and simple of construction, and should require little or no maintenance.

SUMMARY OF THE INVENTION

The present invention overcomes the shortcomings of previously known apparatus for comminuting waste materials by providing feed guide and clearing apparatus which guides material into, through, and out from the intermeshed portions of the rolls and the like. The guide and clearing apparatus of the present invention is less subject to plugging than previously known comb-like clearers, yet simpler than previously known rotary clearers.

According to the present invention finger-like guide-clearer members extend from an infeed side to an outlet side of a pair of intermeshed rolls of the cutting or shredding mechanism, acting as guides for material being fed into the material comminuting apparatus, and acting as clearers to force cut, torn, and shredded material from between spaced-apart rotary material comminuting elements (hereinafter referred to as discs) of each roll of the cutting mechanism. A plurality of such elongate guide-clearer members is associated with each of the rotating rolls, extending through the space between spaced-apart discs of the roll, between the central shaft or spacer of the roll and the outer edge of an intermeshed disc of the opposite roll. The portion of each elongate guide-clearer member nearer the outlet side of the rolls is arcuately curved toward the shaft of the roll between whose discs it extends, thus being curved away from the opposite roll of the apparatus, providing a gradually opening space between the guide-clearer member and the disc of the opposite roll intermeshed in the same space.

Preferably the guide-clearer element presents a front face oriented at an oblique angle to the radius of the discs between which it is located, so that it provides a wedging action to force pieces of material radially outward from between the discs as they rotate.

In a preferred embodiment of the invention each of the guide-clearer members is pivotably supported on an axis which is located on the infeed side of the pair of rolls, extended parallel to the axis of rotation of the rolls. The guide-clearer members are free to move, either toward an intermeshed disc of the opposite roll, or away from the intermeshed disc and toward the center of the roll with which the particular guide-clearer member is associated. A cam may be associated with the central shaft of each cutter roll to force the guide-clearer members to move radially with respect to the roll, thereby periodically dislodging material from between the spaced apart discs.

The guide-clearer members may be of resiliently flexible material whose flexibility permits reduction of the angle between the arcuate face of each clearer member and the direction of travel of adjacent points on the surfaces of the adjacent spaced-apart discs.

A plate may be pivotably mounted over the guide-clearer members associated with each roll, or the guide-clearer members may be attached to such plates, providing a feed chute having closed sides.

It is therefore a principal object of the present invention to provide improved apparatus for guiding materials toward, through, and away from the intermeshed portions of rotating cutter rolls of apparatus for comminuting material.

It is another important objective of the invention to provide simplified apparatus for guiding material to the proper location for being comminuted in waste material comminuting apparatus, and for thereafter removing the reduced material from the path of additional material being reduced to smaller pieces.

It is an important feature of the present invention that it provides a plurality of elongate resiliently flexible guide-clearer member which act to guide material into and out from the area where the reduction in size actually is accomplished.

It is another important feature of the present invention that the clearer members are curved away from the opposite cutter roll, to wedge cut-apart pieces of material radially outward from between spaced-apart discs of the roll.

It is a further feature of the present invention that it provides guide-clearer members which are resiliently flexible, to urge pieces of material outwardly from between spaced-apart discs of a cutter roll with increasing force.

It is a principal advantage of the present invention that it provides a clearer apparatus which is more efficient that radially inwardly directed clearing comb tooth members.

It is another important advantage of the present invention that it requires less power for operation than is required for rotary clearers.

It is a further advantage of the present invention that it provides guide-clearer apparatus which is more easily modified to clear cut apart pieces of material of different sorts from material comminuting apparatus than previously known feeding and clearing apparatus.

BRIEF DESCRIPTION OF THE DRAWINGS

FIG. 1 is a pictorial view of an exemplary tire shredding apparatus including the pivoted resilient guide-clearer apparatus of the present invention.

FIG. 2 is a fragmentary elevational view of a pair of spaced-apart discs of one of the rolls of the tire shredding apparatus shown in FIG. 1, showing the location and orientation of an associated guide-clearer member.

FIG. 3 is a partially cut-away end elevational view of the apparatus shown in FIG. 1.

FIG. 4 is a fragmentary view of a portion of a cutter roll and a portion of a guide-clearer member of the apparatus shown in FIG. 1, at an enlarged scale.

FIG. 5 is a sectional end elevational view of a waste material comminuting apparatus including an alternative embodiment of the guide-clearer apparatus of the present invention.

FIG. 6 is a sectional end elevational view of a waste material comminuting apparatus including a second alternative embodiment of the guide-clearer apparatus of the present invention.

DETAILED DESCRIPTION OF THE INVENTION

With reference now to the drawings, the present invention may be used in association with apparatus for comminuting material, such as the tire shredding apparatus 10 shown in FIG. 1, in which a pair of cutter rolls 12 and 14 include parallel horizontal shafts 16 and 18. A plurality of rotary members such as the cutter discs 20 and 22 are spaced axially apart from one another along, respectively, shaft 16 or 18, and are fixed for rotation with the respective shaft. While the cutter discs 20 and 22 shown herein are of a generally gear-toothed configuration, the term cutter disc as used herein will be understood to encompass broadly various types of rotary members fixed on respective shafts for rotation therewith, such as knife-edged discs, circular and noncircular discs, and rotary hammers or flails. The spacing between centers of the shafts 16 and 18 is less than the diameter of each of the cutter discs 20 and 22, which therefor extend between one another to a distance great enough to effect comminution of the material.

For example, the rolls 12 and 14 and discs 20 and 22 may be 20 inches in diameter, with the centers of the shafts 16 and 18 separated by 19 inches. The discs 20 and 22 may be 2 inches thick and separated axially along each shaft 16 or 18 by a slightly greater distance.

The cutter discs 20 and 22 include circumferential peripheral surfaces 30 and 31 respectively. It will be understood that the cutter discs 20 and 22 may be spaced closely enough together to provide a shearing cooperation with one another to cut apart the material being reduced to pieces of smaller size. It will also be understood that the rolls 12 and 14 may be of any of several different types which may include rotary cutting elements having knife-like circumferential edges, or hook-like or other teeth for graspingly shredding materials. The rolls 12 and 14 may also comprise hammer-like rotating elements, and the present invention remains applicable in these and other types of material communiting apparatus including paired rotating intermeshed rolls and the like.

The shafts 16 and 18 are mounted within a cutter box 24, and are arranged to counter-rotate with respect to one another by, for example, the use of intermeshing spur gears 26 and 28. Surrounding the shaft 16 and located between the cutter discs 20 on the shaft 16 are spacers 32 which maintain the proper distance between the cutter discs 20. Similar spacers 33 are located on the shaft 18 for the same purpose.

The counter-rotation of the cutter rolls 12 and 14 defines an infeed side 34 and an outlet side 36 of the pair of cutter rolls 12 and 14. Supporting structures such as the pivot shafts 38 and 40 are provided on the infeed side 34. Attached pivotably to the pivot shafts 38 is plate 42 which extends upwardly to define one side of an infeed chute 44, a plurality of guide-clearer fingers 46 are attached by conventional fasteners and a backing plate 43 to the plate 42 and extend downward therefrom through respective spaces 48 defined between the spaced apart cutter discs 20, the respective spacer 32 and the peripheral surface 31 of a respective cutter disc 22.

A plurality of guide-clearer fingers 50, similar to the guide-clearer fingers 46, are attached to a plate 52 supported pivotably by the pivot shafts 40. The guide-clearer fingers 50 are attached by conventional fasteners and a backing plate 53 and extend downwardly through respective spaces 54 defined between consecutive spaced apart cutter discs 22, the respective spacer 33 located on the shaft 18, and the peripheral surface 30 of the respective cutter disc 20 extending between a pair of spaced apart cutter discs 22. The plate 52, as the plate 42, extends upwardly, to form an opposite side of the infeed chute 44.

Each of the guide-clearer fingers 46 and 50 extends from its point of attachment to the respective plate 42 or 52 on the infeed side 34 of the pair of cutter rolls 12 and 14, through the respective space 48 or 54, at least beyond the respective shaft 16 or 18, and preferably to a location at least about even with the periphery of the cutter roll 12 or 14 on the outlet side 36.

As may be seen in FIG. 2, each of the guide-clearer fingers 46 and 50 extends downward near the respective spacer 32 or 33 of the roll 12 or 14 with which the respective guide-clearer finger is associated. This leaves a large portion of the respective spaces 48 and 54 in the area between the shafts 16 and 18 and spacers 32 and 33 available for passages of the pieces of material being reduced in size. The portions of the guide-clearer fingers 46 and 50 closer to the outlet side of the tire shredder 10, that is, beyond an imaginary plane 60 interconnecting the centers of the shafts 16 and 18, extend arcuately toward the outlet side 36 of the tire shredder 10 with increasing spacing between the guide-clearer fingers 46 and the guide-clearer fingers 50.

Preferably, each of the guide-clearer fingers 46 and 50 extends arcuately beyond the imaginary plane 60, with an increasing angle of divergence from parallelism with the guide-clearer fingers associated the opposite one of the rolls 12 and 14. An arcuate front surface 62 of each of the guide-clearer fingers 46, and a similar front surface 64 of each of the guide-clearer fingers 50, converges toward tangency with the surface of an imaginary cylinder surrounding the respective cutter roll 12 or 14 with which it is associated. While actual tangency is not desired, it is desired that the angle 65 between the outer surfaces 62 and 64 and a tangent to the general peripheral shape of the respective cutter rolls 12 or 14 be approximately 30° or less.

The guide-clearer fingers 46 and 50 are made preferably of a material such as a spring steel which is resiliently flexible, permitting a respective one of the guide-clearer fingers 46 and 50 to bend resiliently and independently toward tangency with the peripheral surface of the respective cutter roll under the force of a piece of material lodged between the respective pair of cutter discs 20 or 22 between which the respective guide-clearer finger 46 and 50 is located.

In the preferred embodiment the guide-clearer fingers 46 and 50 converge toward one another from the infeed side 34 of the tire shredder 10, curvingly approach parallelism, are approximately parallel with one another in the space directly between the shafts 16 and 18, and thereafter arcuately diverge from parallelism. Other shapes of the guide-clearer fingers 46 and 50 are also usable, as shown in FIGS. 5 and 6. Replacement of the guide-clearer fingers 46 and 50 with ones of other profiles or degrees of flexibility may be easily accomplished without disassembly of the rotatable rolls 12 or 14.

Preferably, each of the guide-clearer fingers 46 and 50 extends through the respective space 48 or 54 without touching any of the cutter discs 20 or 22 on either side. For example, in a tire shredder 10 whose cutter discs 20 and 22 are spaced from one another along the respective shaft 16 or 18 by approximately two inches, a clearance of approximately ⅛ inch is provided between each side of the guide-clearer finger 46 or 50 and the adjacent cutter disc 20 or 22. Additionally, the location of the pivot shafts 38 or 40 and the weight of the guide-clearer fingers may be arranged to provide a slight amount of clearance between the back side 66 of the finger 46 or 50 and the respective spacer 32 or 33. If necessary, such a clearance may be maintained during operation of the tire shredder by provision of a biasing spring 67 shown schematically in FIG. 2.

The outfeed end 68 of each of the guide-clearer fingers is tapered to provide increasing clearance to permit pieces of cut material to fall clear of the guide-clearer fingers.

A wear plate 70 may be provided on the back side 66 of each guide-clearer finger. Such a wear plate may, for example, be made of bronze and may be attached to the respective guide-clearer fingers by conventional fasteners. Particularly, a wear plate 70 may be shaped specially as shown in FIG. 5, to include wedge-like edges 72 extending to the surface of the spacers 32 and 33 to prevent build-up of material which is of such small size that it is able to pass between the guide-clearer finger 42 or 48 and the adjacent cutter disc 20 or 22.

To help guide material into the proper location on the infeed side 34 and to provide further material clearing action, the spacers 32 or 33 may be provided with lobes 74 and 76 arranged in a regular shape as shown in FIG. 6. The wear plate 70 of each guide-clearer finger 46 and 50 may be permitted to rest against the respective spacers 32 and 33, whose cam lobes 74 and 76 then periodically move the guide-clearer fingers 46 and 50 to assist in forcing pieces of comminuted material outward from between the cutter discs 20 and 22.

Referring to FIG. 5, a first alternative embodiment of the invention may be seen to comprise guide-clearer fingers **46*a* and 50*a*, which extend more directly downward than the guide-clearer fingers 46 and 50, and whose lower ends 68 extend further downward and further outward away from the overlapping portions of the cutter discs 20 and 22** than those of the first described embodiment of the invention.

In a second alternative embodiment of the invention, shown in FIG. 6, the guide-clearer fingers **46*b* and 50*b* are pivotably attached to respective shafts 38*a* and 40*a* on the infeed side 34 of the tire shredder 10, and the lower end 68*a* of each guide-clearer finger 46*b* or 50*b* is movably supported, as by a pivotable link 78**.

In operation of the present invention, when material to be reduced to smaller pieces is placed into the tire shredder 10, the plates 42 and 52 of the infeed chute 44 guide the material toward the area on the infeed side 34 where the peripheral surfaces 30 and 31 of the cutter discs 20 and 22 approach one another and the sides of the cutter discs 20 and 22 overlap one another. As the material is cut, torn, sheared, or hammered into smaller pieces, the guide-clearer fingers 46 and 50 prevent the smaller pieces of material from remaining wedged between spaced apart cutter discs 20 or 22 of the rolls 12 or 14, where they would interfere with comminution of additional material fed into the tire shredder 10. The outer arcuate surfaces 62 and 64 of the guide-clearer fingers 46 and 50 force the pieces of material readily outward as the cutter rolls 12 and 14 rotate. The pieces of material slide along the outer arcuate surfaces 62 and 64, whose outwardly spiraling arcuate shape wedges the pieces of material radially outward between the cutter discs 20 or 22 until they fall free and may be collected as desired.

Because of the resilient flexibility of each of the guide-clearer fingers 46 and 50, a piece of material which is lodged particularly securely between a pair of spaced apart cutter discs 20 or 22 may cause the affected guide-clearer finger 46 and 50 to bend toward a shallower outwardly spiraling slope providing an increased mechanical advantage to wedge the material outward from between the cutter discs. In the case of a cam shaped spacer 32 or 33 the periodic reciprocating movement of the guide-clearer fingers 46 and 50 caused by the cam shape helps to force the cut apart pieces of material from between spaced apart cutter discs.

The guide-clearer fingers 46 and 50 of the present invention also operate efficiently to clear material from between the spaced apart cutter discs 20 and 22 as the rolls 12 and 14 are rotated in a reverse direction to clear jammed material from the cutter rolls 12 and 14.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for comminuting waste materials, comprising:

(a) a pair of rotatable rolls having parallel central axes of rotation, said pair of rolls having an infeed side and an outlet side, each roll having a central shaft and a plurality of cutter discs mounted on said shaft and axially spaced apart therealong, defining a plurality of spaces between the cutter discs of each of said rolls, the respective cutter discs of each roll of said pair extending into respective ones of said spaces defined between the cutter discs of the other of said pair of rolls;

(b) a plurality of elongate guide-clearer fingers associated with each of said rolls, each said guide-clearer finger extending through a respective one of said spaces defined between said cutter discs of a respective one of said rolls, between said central shaft of said one of said rolls and a respective cutter disc of the other of said pair of rolls, from said infeed side toward said outlet side; and (c) a plurality of cams located respectively on said rolls, between said cutter discs, said cams including lobe means for periodically moving said guide-clearer fingers radially with respect to said rolls to help feed material to be comminuted from said infeed side into an area wherein said cutter discs of one roll extend into said spaces between said cutter discs of the other roll, while clearing communiuted material from between said cutter discs.

2. The apparatus of claim 1, wherein said cams are fixedly attached to said central shafts in said spaces defined between said cutter discs, for rotation with said shafts.

3. The apparatus of claim 1, each of said guide-clearer fingers having a first end and a second end, said first end being supported in a predetermined location on said infeed side of said pair of cutter rolls, and said second end being located on said outlet side of said pair of cutter rolls.

4. The apparatus of claim 3 wherein said first end is pivotably supported in said predetermined location, and said second end is movable.

5. The apparatus of claim 3 wherein said central axes are approximately horizontal, said apparatus including pivot means for supporting said first ends for rotation about a pivot axis located parallel with said axes of rotation of said cutter rolls, said pivot means being located higher than the tops of said cutter rolls.

6. The apparatus of claim 3 wherein said second end of each said guide-clearer fingers extends arcuately away from the other one of said rotatable rolls.

7. The apparatus of claim 3 wherein said plurality of guide-clearer fingers cooperatively define at least a portion of an infeed chute located on said infeed side of the apparatus.

* * * * *

UNITED STATES PATENT AND TRADEMARK OFFICE

CERTIFICATE OF CORRECTION

PATENT NO. : 4,519,550

DATED : May 28, 1985

INVENTOR(S) : Rouse

It is certified that error appears in the above-identified patent and that said Letters Patent is hereby corrected as shown below:

| | | |
|---|---|---|
| In the title, | | Change "CLEANER" to --CLEARER-- |
| In the abstract, line 7 | | Change "to" to --of-- |
| Col. 1, | Lines 23-24 | Change "other-pass" to --otherwise pass-- |
| Col. 2, | Line 61 | Change "extended" to --extending-- |
| Col. 5, | Line 26 | Change "passages" to --passage-- |
| Col. 5, | Line 37 | After "associated" insert --with-- |
| Col. 7, | Line 1 | Change "readily" to --radially-- |
| Col. 8, | Line 18 | Change "communiuted" to --comminuted-- |
| Col. 8, | Line 40 | After "each" insert --of-- |

Signed and Sealed this

*Ninth* Day of *September 1986*

[SEAL]

*Attest:*

DONALD J. QUIGG

*Attesting Officer*

*Commissioner of Patents and Trademarks*